United States Patent [19]

Elsmo

[11] Patent Number: 4,534,469

[45] Date of Patent: Aug. 13, 1985

[54] TRAY ASSEMBLY

[76] Inventor: Thad F. Elsmo, 208 E. Four Mile Rd., Racine, Wis. 53402

[21] Appl. No.: 547,838

[22] Filed: Nov. 2, 1983

[51] Int. Cl.[3] ..... B65D 3/24

[52] U.S. Cl. ..... 206/560; 206/217; 206/218; 206/553; 206/562; 206/564; 206/807; 229/1.5 B; 312/270

[58] Field of Search ..... 206/0.5, 2.7, 2.8, 225, 206/553, 557, 560, 562, 563, 564, 565, 602, 807; 229/1.5 B, 1.5 R; 220/69; 215/100.5; 222/153; 312/250, 270

[56] References Cited

U.S. PATENT DOCUMENTS

| | | | |
|---|---|---|---|
| Re. 27,688 | 6/1973 | White et al. | 206/564 |
| 1,025,606 | 5/1912 | Bayless et al. | 229/1.5 B |
| 1,157,568 | 10/1915 | Mills | 206/218 |
| 2,556,844 | 6/1951 | Istwan | 206/562 |
| 3,159,371 | 10/1975 | Crabtree | 206/564 |
| 3,179,320 | 4/1965 | Ward | 206/557 |
| 3,295,737 | 1/1967 | Page et al. | 206/564 |
| 3,366,303 | 1/1968 | Kaspar | 206/563 |
| 3,373,917 | 3/1968 | Cox | 206/218 |
| 3,376,974 | 4/1968 | Hilliard | 206/553 |
| 3,386,619 | 6/1968 | Douglas | 206/225 |
| 3,441,353 | 4/1969 | Claff | 206/0.5 |
| 3,965,616 | 6/1976 | Ridgeway | 220/69 |
| 4,093,041 | 6/1978 | Davis et al. | 206/562 |
| 4,306,492 | 12/1981 | Zimmermann | 206/217 |

FOREIGN PATENT DOCUMENTS

| | | | |
|---|---|---|---|
| 84416 | 2/1958 | France | 206/218 |

*Primary Examiner*—Joseph Man-Fu Moy
*Assistant Examiner*—David Fidei
*Attorney, Agent, or Firm*—Andrus, Sceales, Starke & Sawall

[57] ABSTRACT

A tray assembly having a self-contained drinking cup and utensils. The drinking cup is removably mounted on the tray and is movable between a folded storage position and an upright usage position. A clip on the side of the tray holds the cup in its storage position. The tray is also covered with a cellophane seal which is bonded to the clip. The clip engages a rod extending across the interior of a housing containing the trays so that when a tray is removed the clip automatically breaks the cellophane seal and releases the cup.

12 Claims, 5 Drawing Figures

TRAY ASSEMBLY

BACKGROUND OF THE INVENTION

The present invention relates to tray assemblies, and more particularly to a sanitary disposable tray assembly which has a self-contained drinking cup and utensils.

Trays, drinking glasses and utensils are commonly used in the food service industry for serving food in places such as cafeterias, schools, hospitals and the like. Such items are generally reusable and therefore must be washed thoroughly and sanitized after each use. This process results in high energy use and consequently in high utility costs. Also, after cleansing and sanitation these items are handled by various personnel when being stacked for reuse which may result in breakage as well as unsanitary conditions.

SUMMARY OF THE INVENTION

A tray assembly having a self-contained drinking cup and utensils. The tray assembly may be composed of a material such as paper or styrofoam so that it may also be disposed of after use. Thus, the tray assembly eliminates the need for cleansing after use along with the relatively high utility costs which accompany such an operation. The tray assembly may be sealed with cellophane or the like for sanitary purposes.

In one aspect of the invention, the tray assembly includes a tray member having a substantially planar web portion and a plurality of pockets extending downwardly from the web portion with side and bottom walls, and a cup member mounted in one of the pockets and movable between a folded storage position and an upright usage position. The tray assembly also includes means in the form of a clip on the side of the tray member for releasibly holding the cup member in its storage position, and mounting means in the form of interlocking tabs and projections on the cup member and tray member respectively for releasably mounting the cup member on the tray member.

In another aspect of the invention, the entire tray member is covered and sealed with a material such as cellophane or the like for sanitary purposes. The seal is bonded to the clip and the clip interacts with a rod extending across the rear of a housing for holding the trays so that when the tray is removed from the housing the clip engages the rod and automatically breaks the seal and releases the cup.

The present invention thus provides a sanitary disposable tray assembly having a self-contained drinking cup and utensils which eliminates utility costs and avoids breakage problems common in the prior art.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
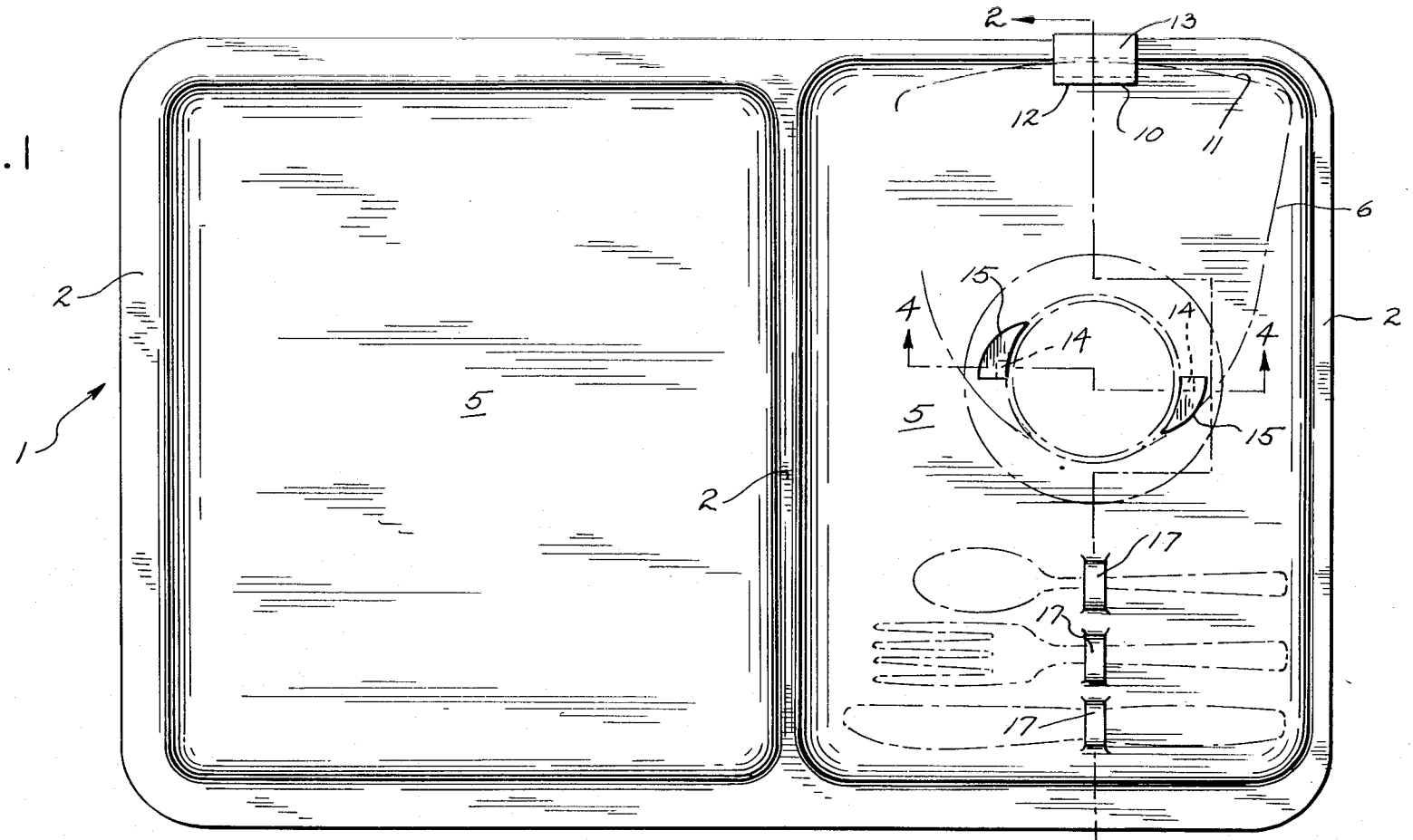
FIG. 1 is a top plan view of the tray assembly of the present invention.

Referring now to the drawings, there is shown a tray assembly constituting a preferred embodiment of the present invention. As shown best in FIGS. 1–3, the tray assembly includes a tray member 1 having a substantially planar web portion 2 and a plurality of pockets 3 extending downwardly from web portion 2. Tray member 1 preferably includes only two pockets 3 for receiving and holding various food items. However, any number of pockets 3 may be utilized with tray member 1 including pockets having dimensions other than those specifically shown herein. Each pocket 3 includes downwardly extending side walls 4 and a bottom wall 5. Pockets 3 are integrally formed along with web portion 2 in a one-piece construction, and may be composed of materials such as pressed paper, cardboard, styrofoam or the like so that member 1 is disposable after use.

The tray assembly also includes a cup member 6 removably mounted in one of the pockets 3. Cup member 6 may be composed of paper or a thin plastic material, and is movable between a flat, collapsed, folded storage position as shown in FIG. 1 and an upright usage position as shown best in FIG. 4. Cup member 6 includes a substantially cylindrical body open at its top and closed at its bottom. Cup member 6 thus defines an upright longitudinal axis when in its usage position, and as shown best in FIG. 1 the body of cup member 6 extends normal to this upright axis when cup member 6 is folded to its storage position so that the entire cup member 6 is located within pocket 3.

The body of cup member 6 includes folding means enabling cup member 6 to be folded or collapsed to its flat storage position. This folding means includes a pair of score lines 7 in the body of cup member 6 positioned diametrically opposite one another and extending from the closed bottom to the open top of cup member 6. Score lines 7 enable member 6 to be readily collapsed to a flat configuration. The folding means also includes a relief slot 8 for each of the score lines 7. Relief slots 8 are cut out of the cup body at the location where the score lines 7 communicate with the open top of cup member 6, as shown best in FIG. 4. Relief slots 8 aid in allowing cup member 6 to maintain a circular configuration when moved to its upright usage position. Without slots 8, cup member 6 would tend to remain in a partially collapsed position instead of returning to a circular configuration. The folding means further includes a corrugated portion 9 at the lower end of the cup body. Corrugated portion 9 extends upwardly from the bottom of cup member 6 to cover approximately one-third the height of cup member 6. Corrugated portion 9 also aids in enabling the cup to be folded to a flat collapsed storage position.

The tray assembly also includes means for releasably holding cup member 6 in its storage position. This releasable holding means comprises a clip member 10 having one end connected to the web portion 2 of tray member 1 and its other end projecting inwardly toward pocket 3. The inner edge of clip member 10 overlaps lip 11 formed on the top edge of cup member 6 so that clip member 10 catches lip 11 and holds cup member 6 in its storage position. As shown best in FIG. 5, clip member 10 includes an abutment surface 12 at its inner end and an inclined top surface 13 that is higher at its inner end than at its outer end. The purposes of surfaces 12 and 13 will hereinafter be described.

Figure 4:
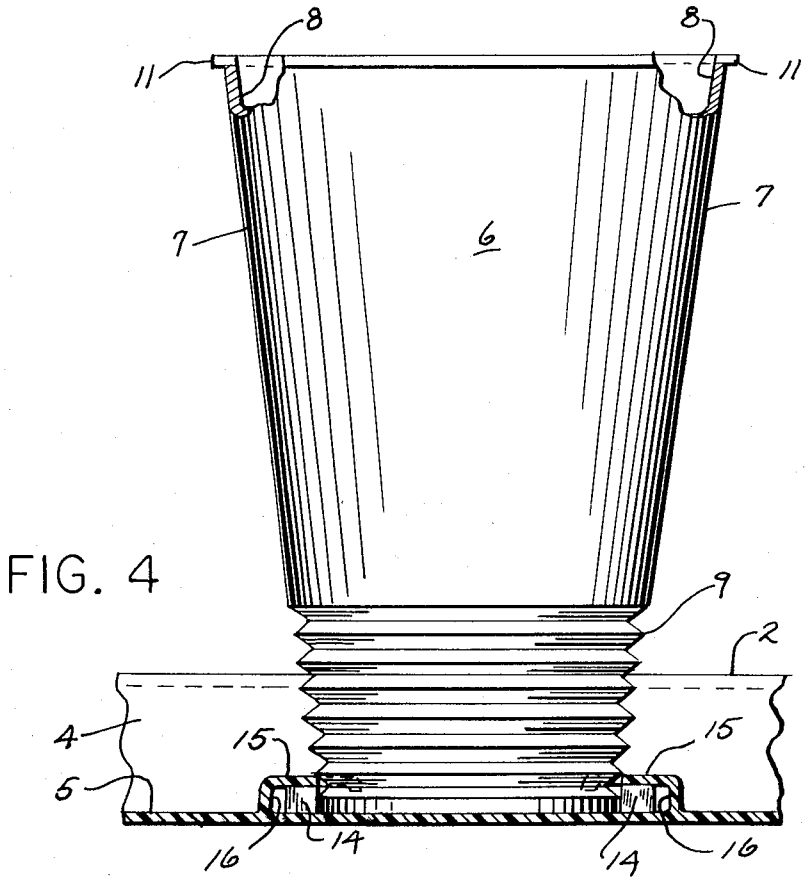
FIG. 4 is a fragmentary side view in elevation with parts broken away and in section illustrating the drinking cup incorporated in the tray assembly of FIG. 1.

As shown best in FIG. 4, cup member 6 is removably mounted in pocket 3 of tray member 1. This removable mounting means includes a pair of locking tabs 14 integrally formed on diametrically opposite sides of the lower end of cup member 6 and extending outwardly from the cup body. A corresponding pair of integral projections 15 extend upwardly from bottom wall 5 of pocket 3 and form oppositely opening tab receiving slots 16. Projections 15 are spaced apart and positioned diametrically opposite one another as shown best in FIG. 1 so that cup member 6 may be rotatably locked and unlocked on tray member 1. In order to accomplish this, cup member 6 may be rotated as shown in FIG. 1 in a clockwise direction for mounting and locking cup member 6 on tray member 1, and in the opposite direction or counterclockwise for removal from tray member 1.

Figure 2:
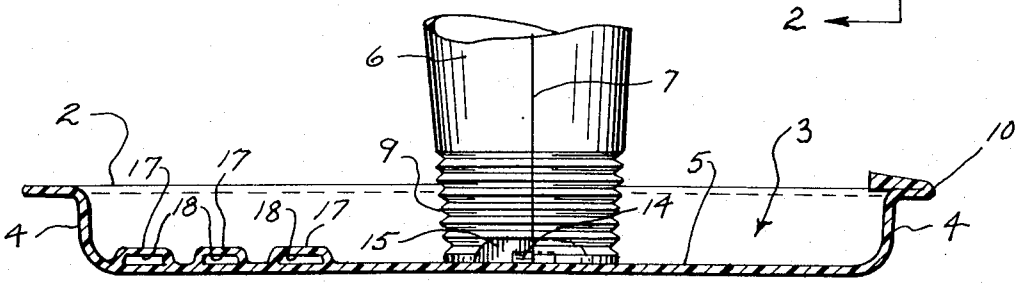
FIG. 2 is a cross-sectional side view in elevation taken along the plane of the line 2—2 in FIG. 1.
Figure 3:
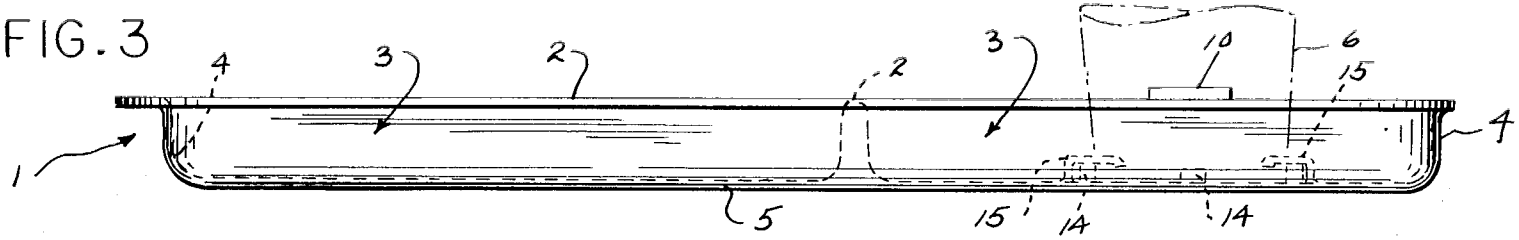
FIG. 3 is an end view of the tray assembly of FIG. 1.

As shown best in FIGS. 1 and 2, the tray assembly includes utensil holding means for holding a variety of utensils such as knives, forks and spoons adjacent cup member 6. This utensil holding means includes a plurality of collar members 17 projecting upwardly from the bottom wall 5 of pocket 3. Each collar 17 forms a utensil receiving pocket 18 which slidably receives a utensil. Each collar 17 is integrally formed from bottom wall 5 of pocket 3, and pockets 18 include dimensions that substantially coincide with the dimension of the utensils inserted therein so that the utensils are frictionally held in position.

Figure 5:
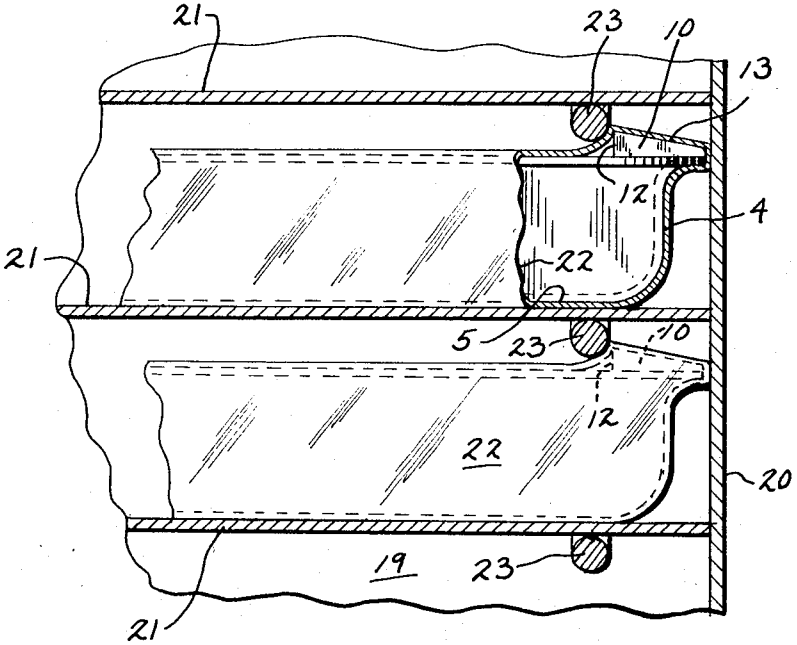
FIG. 5 is a fragmentary side view with parts broken away and in section illustrating the manner in which the seal for the tray assembly is broken when the tray is removed from a rack.

As shown in FIG. 5, each tray member 1 is stored in a housing which includes a pair of opposite side walls 19, a rear wall 20 a plurality of shelves 21 and an open front. The walls 19–21 define tray receiving compartments for slidably receiving and supporting tray members 1 in a stacked arrangement. The housing may typically comprise a rack or cabinet which receives tray members 1 in numerous rows and columns.

In order to maintain a sanitary condition for tray members 1, each tray member 1 is enclosed with a covering 22 of thin transparent material such as cellophane. The cellophane covering 22 overlies the entire tray member 1 including web portion 2, pockets 3 and cup member 6 (when in its folded storage position) for sealingly covering tray member 1.

Cooperating means on tray member 1 and the housing automatically breaks the cellophane seal when tray member 1 is removed from the compartments. In order to accomplish this, each compartment includes a rod 23 extending across the housing between side walls 19. As shown in FIG. 5, each rod 23 is located near the rear of its corresponding compartment and is located beneath a shelf 21. The spacing between each rod 23 and rear wall 20 is slightly greater than the distance between the inner and outer ends of clip member 10. Thus, when slidably inserting tray members 1 the top inclined surface 13 of each clip member 10 engages rod 23 and causes clip member 10 to flex downwardly until upon further inward movement of tray member 1 clip member 10 snaps behind rod 23. In this position tray members 1 are held against accidental removal from the housing. However, when it is desired to remove tray member 1, a person merely grasps the front edge of tray member 1 and pulls tray member 1 outwardly. Upon such action, the front abutment surface 12 of clip member 10 engages rod 23, and upon the exertion of a further removing force by the user clip member 10 is peeled backwardly to automatically break the cellophane seal of covering 22. This action also automatically releases the lip 11 of cup member 6 from beneath clip member 10.

After removal from the housing, a user merely strips the cellophane covering 22 from tray member 1 and moves cup member 6 from its flat collapsed position to its upright usage position by merely grasping the cup body and pulling upwardly. The cup member 6 remains attached to tray member 1 due to the action of tabs 14 and projections 15 so that cup member 6 cannot be accidentally tipped over while carrying tray member 1. However, cup member 6 may be removed by merely rotating it counterclockwise once the user is seated and ready to eat.

A tray assembly has been illustrated and described which includes a cup member 6 removably mounted thereon and movable between a folded storage position and upright usage position. Cooperating means on the tray member and the housing for automatically breaking the seal of the tray member when the tray member is removed from the housing has also been illustrated and described. Various modifications and/or substitutions of the specific components described herein may be made without departing from the scope of the invention. For example, the tray member 1 may be composed of any of a number of materials and may contain pockets having dimensions other than those specifically illustrated herein.

Various modes of carrying out the invention are contemplated as being within the scope of the following claims particularly pointing and distinctly claiming the subject matter which is regarded as the invention.

I claim:

1. A tray assembly, comprising a tray member having a substantially planar web portion and a pocket extending downwardly from said web portion defined by a bottom wall spaced from said web portion and side walls interconnecting said bottom wall and web portion, a cup member removably mounted in said pocket and movable between a folded storage position and an upright usage position, said cup member includes a substantially cylindrical body open at its top and closed at its bottom, said body defining an upright longitudinal axis when in said usage position, and means for folding said body to said storage position wherein said body extends normal to said upright axis, and means for releasably holding said cup member in its storage position, said releasable holding means includes a clip member having one end connected to said web portion and its other end projecting inwardly toward said pocket.

2. The tray assembly of claim 1, wherein the entire cup member is located within said one pocket when in said storage position.

3. The tray assembly of claim 1, wherein said folding means includes a pair of score lines in said body positioned diametrically opposite one another and extending from the top to the bottom of said body.

4. The tray assembly of claim 3, further including a relief slot for each of said score lines cutout of said cup body at the location where said score lines communicate with said open top.

5. The tray assembly of claim 1, wherein said folding means includes a corrugated portion at the lower end of said cup body.

6. The tray assembly of claim 1, wherein the open end of the body of said cup member includes a circumferential lip at least a portion of which extends under the other end of said clip member.

7. The tray assembly of claim 1, further including utensil-holding means adjacent said cup member.

8. The tray member of claim 7, wherein said utensil-holding means includes a plurality of integral collar members projecting upwardly from the bottom wall of said one pocket each forming a utensil-receiving pocket.

9. The tray assembly of claim 1, wherein the removable mounting means for said cup member includes a pair of locking tabs on said cup member and a corresponding pair of integral projections extending upwardly from the bottom wall of said one pocket forming oppositely opening tab-receiving slots whereby said cup member may be rotated in one direction for mounting on said tray member and in the opposite direction for removal from said tray member.

10. In combination, a tray member having a substantially planar web portion and a pocket extending downwardly from said web portion defined by a bottom wall spaced from said web portion and side walls interconnecting said bottom wall and web portion, covering means overlying said web portion and pocket for sealingly covering said tray member, housing means including a pair of side walls defining a compartment for slidably receiving and supporting said tray member, and cooperating means on said tray member and said housing means for automatically breaking said sealing cover when said tray member is removed from said housing means, said cooperating means includes a rod within said compartment extending across said housing means between said side walls and a clip member having one end connected to said web portion and its other end projecting inwardly toward said pocket.

11. The combination of claim 10, wherein said clip member includes an abutment surface at said other end and an inclined top surface that is higher at said other end than at said one end.

12. The combination of claim 10, wherein said tray member includes a cup member removably mounted in said pocket and movable between a folded storage position and an upright usage position, said cup member includes a circumferential lip at least a portion of which extends under said other end of said clip member.

* * * * *